United States Patent [19]

Cauffman et al.

[11] Patent Number: 5,048,782

[45] Date of Patent: Sep. 17, 1991

[54] MAP RAIL HOOK WITH SAFETY NOTCH

[76] Inventors: John R. Cauffman; Janet L. Cauffman, both of 7772 Elden Ave., Whittier, Calif. 90602

[21] Appl. No.: 600,905

[22] Filed: Oct. 22, 1990

[51] Int. Cl.[5] ..... F21V 17/00

[52] U.S. Cl. ..... 248/225.2; 248/307

[58] Field of Search ..... 248/225.2, 262, 267, 248/307, 222.2, 251, 252, 254, 266

[56] References Cited

U.S. PATENT DOCUMENTS 1,786,038 12/1930 Swanson ..... 248/307

4,311,295 1/1982 Jamar, Jr. ..... 248/225.2 X 4,917,244 4/1990 Sayers ..... 248/225.2 X

*Primary Examiner*—Carl D. Friedman

*Assistant Examiner*—Korie H. Chan

*Attorney, Agent, or Firm*—Edgar W. Averill, Jr.

[57] ABSTRACT

An improved map rail hook of the type having a channel portion and a hook portion used to hold a channel member of a map roller assembly. The improved map rail hook has a notch in the base of the hook portion which helps prevent the channel member from becoming unhooked when the map is accidentally caused to rewind too rapidly.

1 Claim, 1 Drawing Sheet

MAP RAIL HOOK WITH SAFETY NOTCH

BACKGROUND OF THE INVENTION

The field of the invention is map holding and displaying apparatus, and the invention relates more particularly to maps which are held on a spring roller of the type commonly used in classrooms. A basic design of map holder which has been on the market for many years is shown in U.S. Pat. No. 1,786,038. This utilizes a map rail which supports several map rail hooks which, in turn, support a map.

Maps are most commonly stored on a spring roller so that they may be easily retracted when not in use. Since many classroom maps are quite large and heavy, it occasionally happens that when the map is released from its unrolled position, the spring in the spring roller causes it to retract rapidly if not restrained by the instructor. The inertia caused by the retracting map can actually lift the channel which is held by the map hooks and occasionally the channel becomes unhooked and can fall to the floor causing possible injury.

Various design improvements have been made over the years including an upper notch on the map rail hook which often is sufficient to restrain the map. Occasionally, however, maps of the present design do fall from the map hooks.

SUMMARY OF THE INVENTION

It is an object of the present invention to provide a map hook with a safety notch which further helps prevent the unwanted unhooking from the map during rapid withdrawal.

The present invention is for an improved map rail hook of the type having a channel portion and a hook portion extending outwardly and upwardly therefrom. The hook portion has a bottom edge, a front edge including a front notch and a hook base. The improvement comprises a lower notch formed near the middle of the hook base whereby the bottom edge of a channel member of a map supporting assembly will catch in the lower notch and be less likely to be accidentally unhooked from the improved map hook.

DESCRIPTION OF THE PREFERRED EMBODIMENTS

Figure 1:
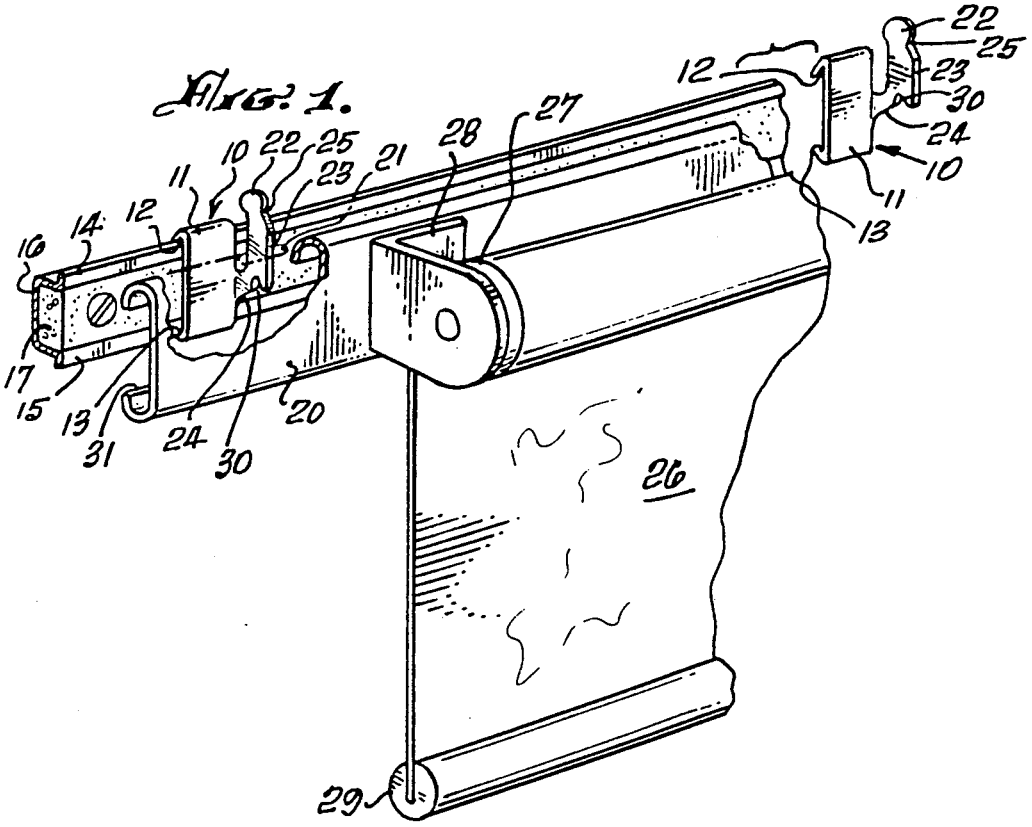
FIG. 1 is a perspective view showing a map rail supporting two map rail hooks which, in turn, support a channel member and an associated map.
Figure 2:
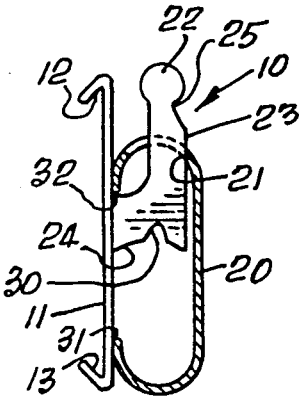
FIG. 2 is a cross-sectional side view showing the channel member and map rail hook of FIG. 1.

The map rail hook of the present invention shown in perspective view in FIG. 1 and indicated by reference character 10. There are two map rail hooks shown in FIG. 1 and both have been given the same reference characters. Map rail hook 10 has a channel portion 11 with an upper edge 12 and a lower edge 13. Edges 12 and 13 pass over the flanges 14 and 15, respectively, of map rail 16. Map rail 16 has a cork portion 17 and is of a conventional construction. In order to support a map and associated roller assembly, a pair of map rail hooks 10 are slid onto map rail 16, as shown in FIG. 1, and the channel member 20 has a pair of openings 21 (only one of which is shown in FIG. 1) and the map rail hooks are slid so that they match the position of openings 21. The supported channel member 20 is shown in cross-sectional view in FIG. 2 where it can be seen that the map rail hook has a hook portion 22 which has a front edge 23, a bottom edge 24 and an upper notch 25.

The map 26 is held on a spring roller 27 which, in turn, is supported by a pair of roller brackets 28 (only one of which is shown in FIG. 1). A wooden handle 29 extends outwardly at each end of map 26 so that the map will not freely rotate when it is retracted but, instead, handle 29 will abut roller bracket 28. Map 26 is made of heavy, coated synthetic paper, and when the map is released, the channel member can move upwardly as shown in FIG. 3 or FIG. 4, and in the past would occasionally become dislodged from the map hooks.

Figure 3:
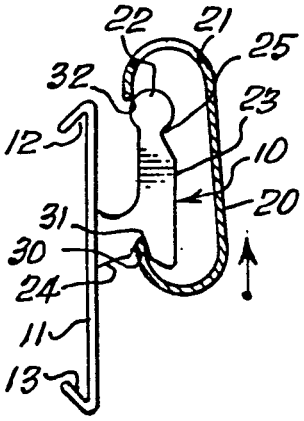
FIG. 3 is a side view showing the map rail hook with the channel member in an upward position.
Figure 4:
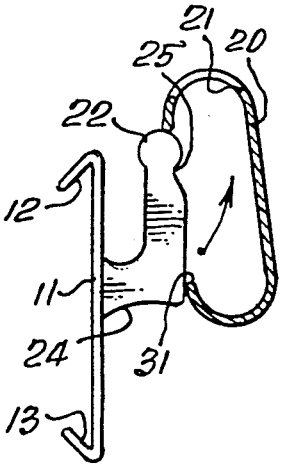
FIG. 4. PRIOR ART
FIG. 4 is a side view showing the prior art map rail hook and a channel member slipping off of the prior art map rail hook.

As shown in FIG. 3, a lower notch 30 can catch the bottom edge 31 of channel member 20 so that the top edge 32 will be held by hook portion 22. In the past, as shown in FIG. 4, the bottom edge 24 of the hook would permit the bottom edge 31 of the channel portion to slide along the edge and slip out.

Lower notch 30 merely provides a stable holding place when channel member 20 tries to move upwardly.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. The combination of a map supporting assembly of the type having a channel member with upper and lower edges and an improved map rail hook of the type having a channel portion and a hook portion extending outwardly and upwardly therefrom, said hook portion having a bottom edge, a front edge including a front notch and a hook base wherein the improvement comprises:

a lower notch formed near the middle of the hook base said lower notch comprising a discreet indentation in said hook base, whereby the bottom edge of said channel member of said map supporting assembly will catch in the lower notch and be less likely to be accidentally unhooked from the improved map hook.

* * * * *